US005823397A

United States Patent [19]

Gil

[11] Patent Number: 5,823,397

[45] Date of Patent: Oct. 20, 1998

[54] PERSONAL HYGIENE LIQUIDS DISPENSER WITH AN IMPROVED VALVE SEAT

[75] Inventor: Amos Gil, Farmington Hills, Mich.

[73] Assignee: Masco Corporation, Taylor, Mich.

[21] Appl. No.: 839,701

[22] Filed: Apr. 15, 1997

[51] Int. Cl.[6] ..... B67D 3/00

[52] U.S. Cl. ..... 222/181.3; 222/501; 222/518; 251/321; 251/324

[58] Field of Search ..... 251/321, 324, 251/356; 222/501, 507, 509, 518, 181.3

[56] References Cited

U.S. PATENT DOCUMENTS

| | | | |
|---|---|---|---|
| Re. 6,464 | 6/1875 | Hopkins . | |
| D. 324,619 | 3/1992 | Comstock et al. . | |
| 591,228 | 10/1897 | Goltermann . | |
| 656,296 | 8/1900 | Ulmer et al. . | |
| 711,846 | 10/1902 | Gossard . | |
| 1,553,113 | 9/1925 | Rutt . | |
| 2,075,167 | 3/1937 | Broecker | 251/356 X |
| 2,464,030 | 3/1949 | Engstrom . | |
| 2,529,365 | 11/1950 | Barksdale . | |
| 2,612,342 | 9/1952 | Terry | 251/321 X |
| 2,623,785 | 12/1952 | Henchert | 222/501 X |
| 2,976,010 | 3/1961 | Huthsing, Sr. | 251/321 X |
| 3,148,700 | 9/1964 | Friedell . | |
| 3,164,302 | 1/1965 | Indjian . | |
| 3,168,353 | 2/1965 | Horowitz . | |
| 3,190,284 | 6/1965 | Koepf . | |
| 3,231,236 | 1/1966 | Hodel et al. . | |
| 3,487,853 | 1/1970 | Kern, Jr. . | |
| 3,540,636 | 11/1970 | Dvoracek | 222/501 |
| 3,720,352 | 3/1973 | Kozlowski . | |
| 3,730,224 | 5/1973 | Prisk . | |
| 3,920,160 | 11/1975 | Casale et al. . | |
| 4,133,345 | 1/1979 | Mitchell | 222/509 X |
| 4,271,986 | 6/1981 | Stecker | 222/501 X |
| 4,949,877 | 8/1990 | Hanna et al. . | |
| 5,183,182 | 2/1993 | Comstock et al. . | |
| 5,244,185 | 9/1993 | Clapp et al. | 251/321 |
| 5,452,825 | 9/1995 | Comstock et al. | 222/181.2 X |

*Primary Examiner*—Kenneth Bomberg
*Attorney, Agent, or Firm*—Reising, Ethington, Learman & McCulloch

[57] ABSTRACT

A liquid dispenser assembly (10) for personal hygiene liquids includes a container (14) and a dispenser valve (16). Each valve includes a valve plunger (60) with a head (62) having a flexible peripheral skirt (64) that provides increased bypass of liquid upon harder pressing and faster motion of the plunger. The valve (16) has an annular seat (85) that has a tapered seat surface (88) that presses the flexible skirt (64) against the valve inner cylindrical wall (54) of the valve bore (52) at the end of the return stroke.

9 Claims, 3 Drawing Sheets

PERSONAL HYGIENE LIQUIDS DISPENSER WITH AN IMPROVED VALVE SEAT

TECHNICAL FIELD

The field of this invention relates to a fluid dispenser for use with liquid soap, shampoo, conditioner and other personal hygiene liquids.

BACKGROUND OF THE DISCLOSURE

The convenience of liquid personal hygiene products, such as soap, shampoo, hair tonic, skin cream, hair conditioner, and baby oil is known and many types of dispensers have been developed to accommodate personal hygiene liquids. While these personal hygiene liquids are often used with simple gravity fed valve dispensers, the viscosity of many of these products prevents a satisfactorily adequate flow from the container. As a consequence, plunger type pumps that forcefully discharge the liquid under pressure have been developed. These plunger type pumps are used with a one way check valve. The check valve allows liquid from the dispenser container to flow into the valve cylinder upon each return stroke of the plunger but prevents liquid from backing up into the dispenser container during the plunger actuation stroke such that the liquid is then forced out through a discharge nozzle.

These valves push the personal hygiene liquids out with each stroke. It has been recently found that a flexible skirt functions well on the plunger head to allow liquid to pass by the plunger head when the valve is pushed. The skirt flexes radially inward to allow the liquid to flow around the inwardly flexed skirt as the skirt plunges forward. During the return stroke, the skirt reassumes its radially outer position with its periphery abutting the wall of the delivery cylinder such that the skirt pushes the liquid out to the outlet. It has also been found that if the skirt is forced radially outwardly during rest, its outer periphery can function as a seal against the cylinder wall to prevent undesirable leakage of liquid out from the nozzle.

The positive pressure to push the skirt outward 14 is particularly helpful if the cylindrical bore due to manufacturing tolerances is slightly out of true round. In this situation, the skirt is biased outwardly as needed until it abuts completely to the cylindrical wall. If the skirt does not retain its resiliency or is not biased outwardly, the operation of the valve can be detrimentally affected during the return stroke and may cause leakage.

A common set up for these plungers is to have the supply container on top, the plunger and delivery cylinder horizontally disposed and situated below the container, and a downward facing outlet nozzle. The outlet nozzle is often axially displaced forwardly from the inlet connected to the container to provide a more convenient location for the discharge of the liquid. This setup is particularly useful where the dispenser is mounted on a wall and the push button of the plunger faces the user so that the discharge outlet is spaced a sufficient distance from the wall to allow a person's hand to be situated fully under the discharge nozzle in order to receive the soap.

In this setup, the inlet from the container to the valve cylinder is axially spaced from the discharge outlet a significant amount. It has been desirable to seat the plunger head close to the inlet such that when the plunger head is actuated, it moves under the inlet to provide flow to the discharge outlet. Consequently, the valve seat for stopping the plunger head at its biased rest position is significantly spaced from the front axial end of the valve cylinder. While prongs may extend from a cap to form a seat for the skirt of the valve, the prongs may be prone to breakage due to lack of support of their distal ends.

What is needed is a durable plunger driven liquid dispenser that has the plunger skirt seated on a durable annular seat that forces the skirt outwardly to seal against the cylinder wall such that the nozzle is sealed against leakage when not in use.

SUMMARY OF THE DISCLOSURE

In accordance with one aspect of the invention, a liquid dispenser valve includes a housing having an inlet port connectable to a supply container, a cylinder sized to receive a plunger head, and a discharge nozzle axially positioned forwardly in the cylinder. A check valve is mounted in the inlet port to restrict the flow of liquid upstream out of the inlet port. A plunger is mounted for forward and rearward axial movement in the cylinder. A return spring is interposed between the plunger and a closed axial end of the cylinder. The return spring resiliently biases and moves the plunger forwardly for a return stroke to a first axial position between the inlet port and the discharge outlet but allows a stroking motion of the plunger to a rearward second axial position away from the discharge outlet.

The plunger has a head with a flexible periphery commonly referred to as a skirt that when resting in the first axial position abuts against the cylinder wall to form a seal against leakage of liquid from the container to the discharge nozzle. When the plunger is pushed rearwardly to the second position, the skirt is flexed inwardly to allow liquid to flow by the plunger head and flow from the inlet port to the discharge spout. To accomplish this function, the flexible skirt has a cant that is defined as radially outward and axially forward. The plunger has a plunger rod connected to the head that extends out of a front end of the cylinder and attachable to a push button for manual operation of the plunger.

A closure cap is removably connected to a front end of the housing and about the plunger rod. The closure cap has seals interposed between itself, the cylinder wall, and the plunger rod. An annular seat is mounted in the cylinder for abutting an inner wall of the skirt when the plunger head is in the first axial position. The seat is annular to provide for structural support of the seat. The seat biases the flexible skirt outwardly such that the skirt abuts the cylinder wall and forms a seal within the cylinder to prevent fluid from passing to the discharge nozzle when the plunger rests in the first axial position. The seat surface of the annular seat has a notch therein that allows liquid on the downstream side of the skirt to flow from between the skirt and seat surface to the nozzle. Desirably the seat surface is tapered such that its distal end is assured to abut against the inner surface of the skirt to press the outer skirt wall to bear against the wall of the cylinder. As such, the seat surface is also canted to extend radially outward and axially forward. Desirably, the seat is affixed to or is formed as part of the closure cap.

In a dispenser built in this fashion, an expeditiously constructed seat provides support for adequately seating the skirt of the plunger head for sealing against the cylinder wall when the dispenser is not in use.

BRIEF DESCRIPTION OF THE DRAWINGS

Reference now is made to the accompanying drawings in which.

DESCRIPTION OF THE PREFERRED EMBODIMENT

Figure 1:
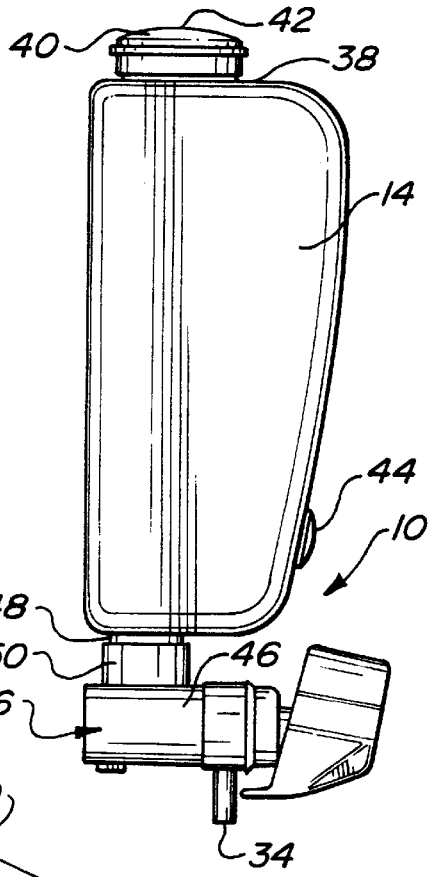
FIG. 1 is a side elevational view illustrating a dispenser container and dispenser valve assembly in accordance with an embodiment of the invention.

Referring now to FIG. 1, a liquid dispenser assembly 10 includes a container 14 connected to a dispenser valve 16. The container 14 may be directly mounted on a wall or be housed in a housing (not shown) with other identical dispenser assemblies 10. The container 14 is preferably made from a transparent plastic to allow for easy visualization of the amount of liquid in the container 14. The top has a refill aperture 38 that snap fits a plastic cap 40 that has a small air aperture 42 therethrough. The container 14 also has a small embossed side window 44. The bottom of the container has an outlet neck portion 48 that is adhered to a inlet port 50 of valve body 46. Such adherence may be formed by an adhesive glue.

Figure 2:
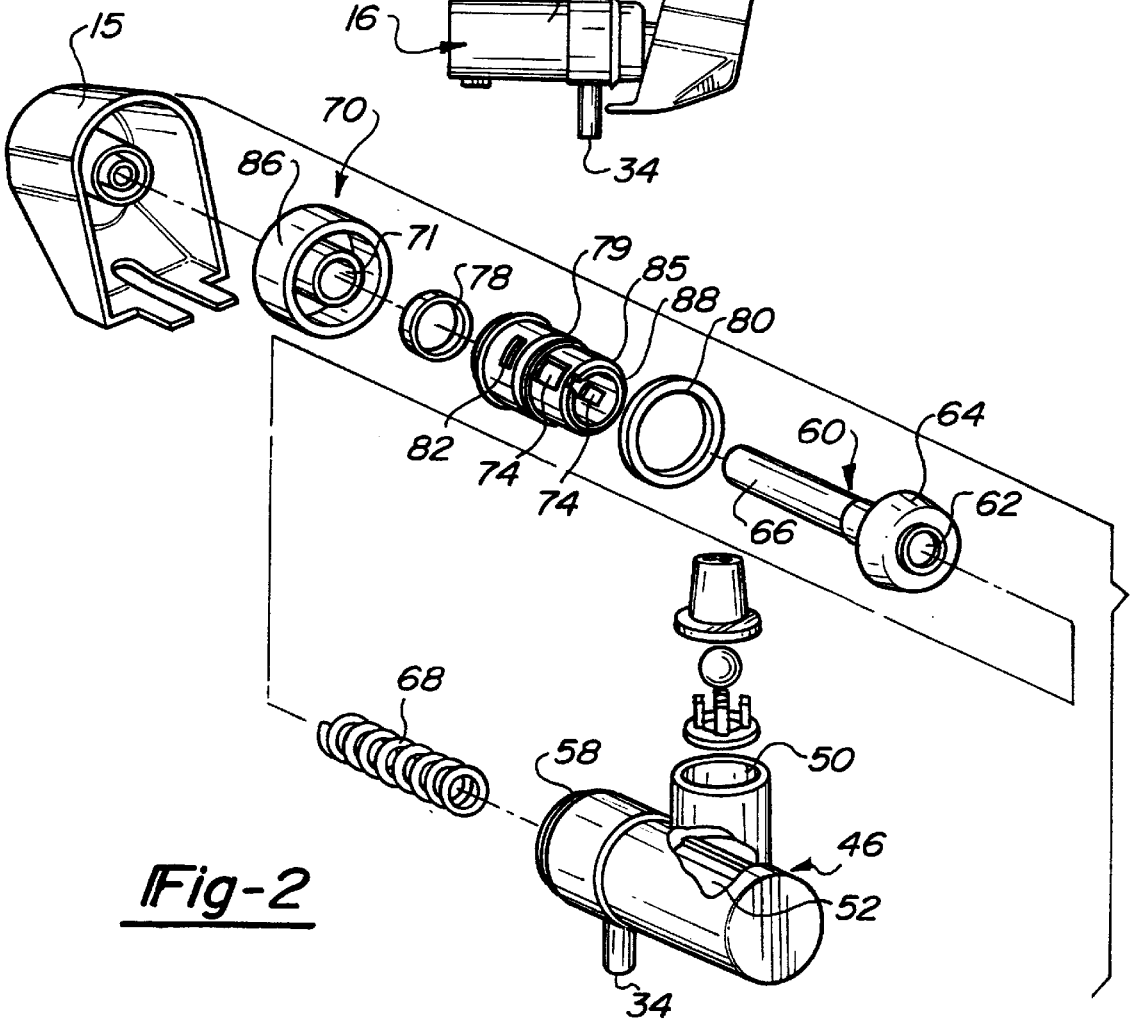
FIG. 2 is an exploded rear perspective view of the dispenser valve shown in FIG. 1.
Figure 3:
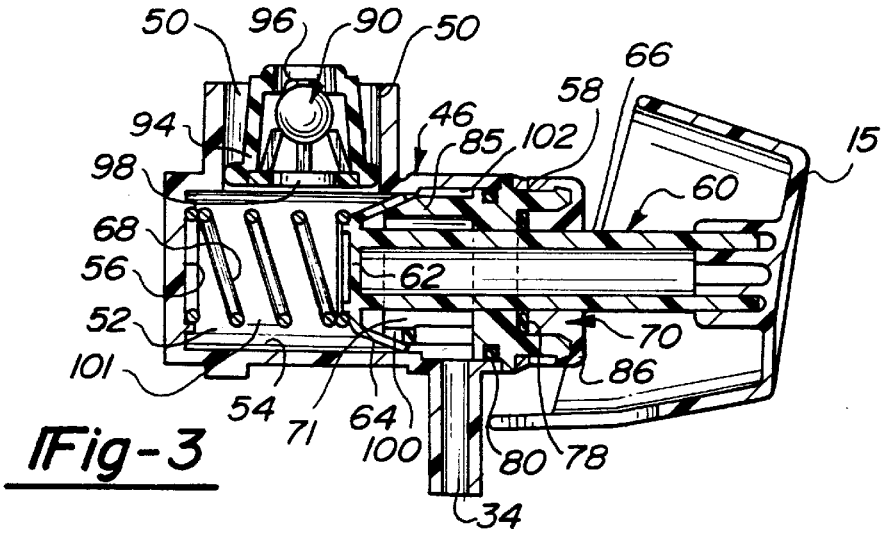
FIG. 3 is a side elevational and segmented view of the dispenser valve shown in FIG. 2 with the valve in the rest or unused position.

As shown in FIGS. 1, 2, and 3, the valve body 46 has the inlet port 50 axially spaced from the discharge spout 34. The port 50 and spout 34 are connected via a cylinder bore 52 with an inner wall 54. The bore has a closed rear end 56 and an open front end 58.

A plunger 60 has a head 62 with a flexible periphery hereinafter referred to as a skirt 64 connected to a plunger rod 66. The flexible head 62 is sized to have its skirt 64, when in a rest position to abut the cylindrical wall 54 as shown in FIG. 3. The skirt is generally canted to extend both radially outward and axially forward. A return spring 68 is interposed between the head 62 and the closed end 56 for biasing the plunger 60 to the position shown in FIG. 3.

A cap assembly 70 has a seat and spacer member 72 that provides a stop for the plunger. The cap assembly seals the open outer end 58 of valve and has a central bore 71 that allows the rod 66 to extend through the cap assembly 70 and out of the valve body 46.

Figure 6:
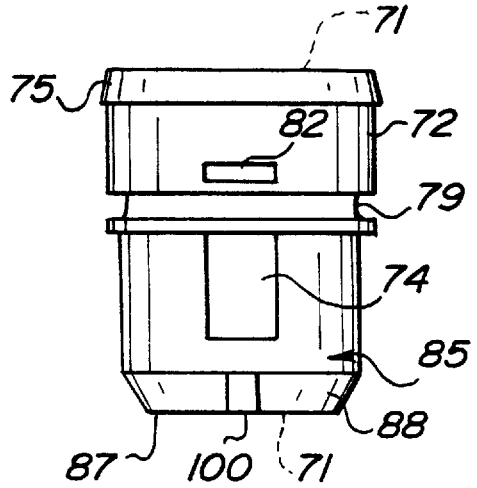
FIG. 6 is an enlarged side elevational view of the valve seat and spacer member shown in FIG. 2.
Figure 7:
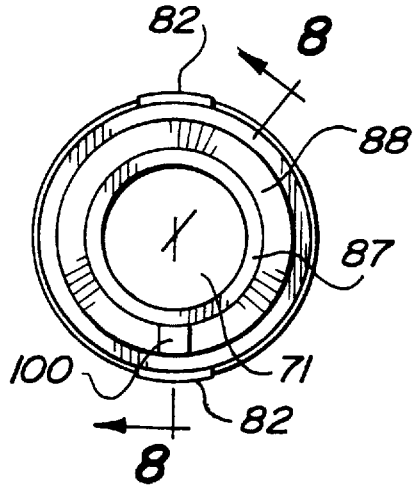
FIG. 7 is a rear elevational view of the sleeve and space member shown in FIG. 6.
Figure 8:
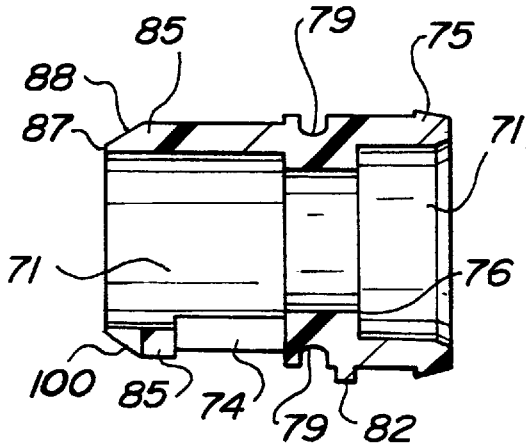
FIG. 8 is a cross-sectional view taken along lines 8—8 shown in FIG. 7.

Referring now to FIGS. 3 and 6,the seat and spacer member 72 has an internal seat 76 that seats o-ring 78 for sealing the seat and spacer member with the rod 66. The seat and spacer member also has an external circumferential groove 79 that seats external o-ring 80. The o-ring 80 seals the seat and spacer member with the wall 54. As labeled in FIG. 4, the seat and spacer member 72 has tabs 82 outboard of the o-ring groove 79. The tabs 82 that snap fit into apertures 84 to retain the cap assembly 70 in place against normal forces encountered from actuation of the rod 66 and bias from the return spring 68. The seat and spacer member 72 has a lip 75 that snap fits into a cap cover 86 to retain the internal o-ring 78 in place. Operating button 15 is attached to the front end of rod 66.

The seat and spacer member 72 includes an annular seat 85 for engaging the skirt. The axially inner end of the seat 85 has a tapered surface 88 that has its distal tip 87 abutting an inner surface 89 of the flexible skirt 64. The tapered seat surface 88 conforms to push and seat the flexible skirt against the cylinder wall 54 such that the skirt forms a seal against the cylindrical wall 54 when the skirt is in the seated and rest position shown in FIG. 3, In other words, the surface 88 is also generally canted to extend both radially outwardly and axially forward. The surface 88 has at least one recessed notch 100 therein to promote flow of liquid from between the inner surface 89 of skirt and the tapered seat surface 88 to the central bore 71. A pair of apertures 74 passes through the annular seat 85 on opposing sides of the seat 85. The apertures 74 provide for better flow to discharge spout 34. The outer diameter of the annular seat 85 is less than the internal diameter of the cylinder bore 52 such that liquid can flow through the annular gap 102 formed between the annular seat 85 and the inner wall 54 of cylinder bore 52. The annular seat 85 has the appropriate axial length from groove 72 to properly position seat surface 88.

Figure 4:
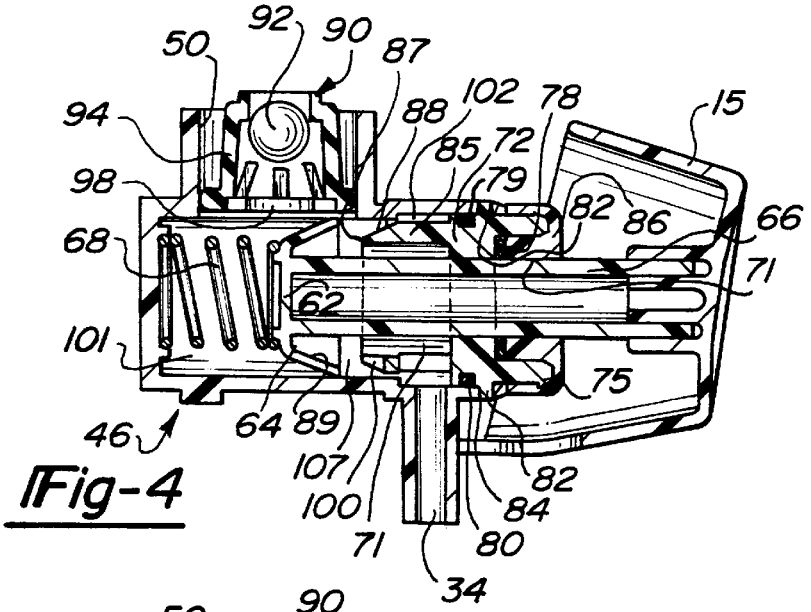
FIG. 4 is a view similar to FIG. 3 with the dispenser valve shown in the intermediate position during an actuation stroke.
Figure 5:
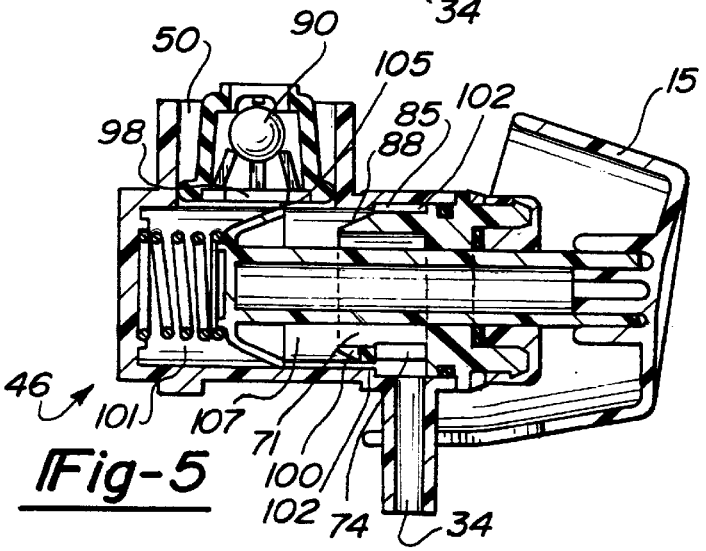
FIG. 5 is a view similar to FIG. 3 with the dispenser valve shown in the fully pressed position.

A check valve 90 is mounted in the inlet port 50 for restricting flow from the valve body 46 back to container 14. The check valve has a ball element 92 seated in a cage 94. The ball is normally in the position shown in FIG. 3 with the ball 92 in the open position that allows relatively unrestricted flow through the cage from seat 96 through lower outlet 98 and into valve body 46. The check valve also prevents substantial flow back into the container when the plunger is being pushed as shown in FIGS. 4 and 5.

Initially when the button 15 is at rest, the spring 68 pushes the rod 66 forwardly to the position shown in FIG. 3 to force the flexible skirt 64 against the tapered seat surface 88 such that the skirt 64 forms a seal against the inner cylindrical wall 54. The seal closes off communication between the container and the discharge spout and prevents leakage from container 14 through discharge spout 34.

Operation of the dispenser is extremely convenient. The operator merely pushes button 15 when liquid is desired from discharge spout 34. Upon pressing the button shown in FIG. 4, the rise in pressure within the cylinder bore 52 forces the ball 92 upward against seat 96. Further pressing of the button, moves the plunger into the cylinder bore 52 which causes liquid in the rear section 101 of the cylinder bore 52 to flow by the plunger head 62 toward and out through to flow by the plunger head 62 toward and out through discharge spout 34. The flexible skirt also flexes radially inwardly to accommodate the passage of liquid by the plunger head 62. When the plunger head is pressed past the forward end 103 of inlet port 50 as shown in FIG. 5, the liquid can also pass by the top end of skirt along section 105 to be discharged through the spout 34. At the end of the stroke, the ball 90 drops back down as shown in FIG. 5.

Upon release of the button 15, the spring 68 pushes the plunger 62 forward thereby increasing the size of the rear section 101 of the bore 52 and the liquid from the container passes through the open inlet port 98 to refill the cylinder bore 52. The small air aperture 42 in the cap 40 of container 14 prevents a vacuum buildup within the container to maintain adequate liquid flow into the valve 16 from container 14 upon the return stroke of the plunger. The spring returns the plunger to the position shown in FIG. 3 and allows for immediate repeated actuation of the button 15.

The return stroke of the plunger head 62 also provides a wiping action of the inner cylinder bore 52 by the flexible skirt 64 of head 62. The wiping prevents any viscous fluid to remain in the bore 52 clinging to the wall and congealing thereon which would otherwise eventually render the valve mechanism useless. The cylinder bore 52 is refilled with fresh liquid from the container with each and every full stroke of the plunger. Furthermore, the wiping action provides that the liquid or fluid within the front section 107 of the cylinder bore 52 in front of the head 62 is pushed out through the discharge spout 34 during the return stroke.

The flexible skirt 64 virtually eliminates the possibility of excessive pressure being built up within the valve body. The faster the plunger is pushed, the more the skirt flexes radially inward providing a greater opening to the discharge spout which provides for a greater bypass flow from section 101 and out to the discharge spout 34.

The annular seat by pressing against the inner surface of the skirt assures that a complete seal between the skirt and the cylindrical wall. This seal occurs even if the cylindrical wall is due to manufacturing tolerances, out of round. This seal prevents leakage from the container 14 to the spout 34.

In this fashion, a durable and long lasting dispenser also provides leak free sealing of the liquid within the container and proper and easy dispensing of the liquid when desired. The dispenser is expeditiously constructed, easily operated and easily maintained.

Variations and modifications are possible without departing from the scope and spirit of the present invention as defined by the appended claims.

The embodiments in which an exclusive property or privilege is claimed are defined as follows:

1. In a liquid dispenser valve characterized by:

a housing having an inlet connectable to a supply container, a cylinder sized to receive a plunger head and a discharge nozzle axially positioned along a forward position in said cylinder; a check valve mounted in said inlet to restrict the flow of liquid upstream out of said inlet; a plunger mounted for axial movement in said cylinder; a return spring interposed between the plunger and a closed axial end of said cylinder for resiliently biasing and moving said plunger forwardly for a return stroke to a first axial position between said inlet and said discharge outlet and to allow a stroking motion to a rearward second axial position toward said inlet; said plunger having a head with a flexible skirt with an inner wall and outer wall, the flexible skirt when in the first axial position has its outer wall abutting against the cylinder wall to form a seal against leakage of liquid from a supply container to said discharge nozzle and when moved rearwardly to said second position being flexed inwardly to allow liquid to flow by said plunger head from said inlet to said discharge spout; said plunger having a plunger rod connected to said head that extends out of a front end of said cylinder and for manual access to push said plunger; a closure cap removably connected to a front end of said housing and about said plunger rod and having seals interposed between itself and said cylinder wall and said plunger rod; the improvement comprising:

an annular seat for said inner wall of said skirt for abutting said inner wall of the periphery of said plunger head when said plunger head is in said first axial position to bias said skirt outwardly to abut said cylinder wall such that a seal is formed between said skirt and said cylinder wall to prevent fluid from passing to said discharge nozzle when said plunger rests in said first axial position.

2. A liquid dispenser valve as defined in claim 1 and further comprising:

said skirt having a cant that is radially outward and axially forward;

said seat including a substantially annular and tapered seat surface to seal the skirt against said inner wall of said cylinder with said taper extending radially outward and axially forward.

3. A liquid dispenser valve as defined in claim 1 further comprising:

said substantially annular seat surface having a notch therein for providing passage of liquid therethrough.

4. A liquid dispenser valve as defined in claim 3 further comprising:

said annular seat being affixed to said closure cap to form a closure cap assembly.

5. A liquid dispenser valve as defined in claim 2 further comprising:

said annular seat being affixed to said closure cap to form a closure cap assembly.

6. A liquid dispenser valve as defined in claim 2 further characterized by:

said annular seat having an outer diameter that is less than the diameter of the cylinder such that an annular gap is formed between the inner wall of said cylinder and said annular seat.

7. A spacer and seat member for a liquid dispenser valve, said spacer and seat member characterized by:

an annular body section having an outer circumferential groove for seating an o-ring;

said annular body section constructed to receive a second o-ring about a central bore in said annular section;

an annular dispenser valve seat section integrally formed and axially extending from said body section;

said valve seat section being annular in shape with a central bore; and said valve seat section having a distal annular surface that has a diameter small enough to intrude into a skirt of a plunger.

8. A valve seat and spacer member as defined in claim 7 further characterized by:

said valve seat surface being tapered and having a notch therein.

9. A valve seat and spacer member as defined in claim 8 further characterized by:

said annular valve seat section having a radially extending aperture therethrough.

* * * * *